US006386886B1

(12) United States Patent
Filaretos

(10) Patent No.: US 6,386,886 B1
(45) Date of Patent: May 14, 2002

(54) GIMBAL SYSTEM

(75) Inventor: William A. Filaretos, Salem, MA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/393,951

(22) Filed: Sep. 9, 1999

(51) Int. Cl.[7] ..... H01R 39/00

(52) U.S. Cl. ..... 439/21; 74/5.6 D

(58) Field of Search ..... 439/21, 11; 310/232, 310/237; 200/11 DA; 74/5.6 D, 5 R; 73/504.12

(56) References Cited

U.S. PATENT DOCUMENTS 3,396,586 A * 8/1968 Maclin et al. ..... 74/5.6 D
3,517,108 A * 6/1970 McCarthy ..... 310/237
3,837,229 A * 9/1974 Stiles et al. ..... 310/232
4,046,441 A * 9/1977 Harley ..... 439/164
4,246,453 A * 1/1981 Marchese et al. ..... 200/11 DA
4,267,737 A * 5/1981 O'Connor et al. ..... 74/5.6 D
4,591,674 A * 5/1986 Rose et al. ..... 200/11 DA
4,665,764 A * 5/1987 Inoue et al. ..... 74/436
5,484,294 A * 1/1996 Sobhani ..... 439/21
5,719,335 A * 2/1998 Nakaishi et al. ..... 74/5.6 D

* cited by examiner

*Primary Examiner*—Neil Abrams
(74) *Attorney, Agent, or Firm*—Daly, Crowley & Mofford LLP

(57) ABSTRACT

A system includes a slip ring plate and a pair of brush assemblies mounted on each side of a housing. The disk-shaped slip ring plate is mounted to a first gimbal member and has a plurality of concentric, truncated circular shaped electrical conductive segments disposed on one surface thereof, the electrical conductive segments being electrically insulated from each other and divided (truncated) into half circular segments by discontinuities on each side of the slip ring plate. Pins (22) are fixed to a cylinder (152) on the gimbal (22). The pins (22) pass through acruate slots (40) in the slip ring (18). Motors (14, 16) are used to cause rotation of the gimbal with the slip ring remaining stationary until the pins engage ends of the slots (40), the slip ring then rotating with the gimbal, the rotation being limited by slip ring stops engaging housing stops. The brush assembly has a like plurality of brushes, each of the brushes being positioned in electrical contact with a corresponding one of the plurality of conductive segments while the brush assembly and disk-shaped ring platter rotate with respect to each other about an axis common to the concentric, truncated circular shaped conductive segments.

3 Claims, 8 Drawing Sheets

GIMBAL SYSTEM

BACKGROUND OF THE INVENTION

This invention relates generally to gimbal systems and more particularly to gimbal systems adapted for use in guided missile seekers.

As is known in the art, gimbal system are used in a wide range of applications. One such application is in guided missile seekers. More particularly, guided missiles typically include in the frontal portion thereof a seeker, such as a radar, infrared, or electro-optical seeker, disposed within the missile's body behind a dome (i.e., a radome or IR dome, for example). The seeker is mounted to the interior body of the missile, by a gimbal system, such as a three-degree of freedom pitch-yaw gimbal system or a six-degree of freedom pitch-yaw-roll gimbal system.

The seeker includes a sensor, such as a radar antenna, on IR detector, or a laser energy detector, and associated electronics, such as hybrids, A/D converters. amplifiers, etc, and additional support devices, such as body rate sensors (i.e, gyros), torque motors, and resolvers, etc. Further, the gimbals are driven by motors in response to signals supplied by the missile's guidance system and fed to the sensors, associated electronics, additional support devices, and motors through cables. In some applications, as many as 70 cables are required for the seeker/gimbal system.

Typically, these cables, or electrical wires, are harnessed and such harness wraps around a gimbal axis to provide a "service loop" configuration to accommodate large gimbal angles. A harness of this size is relatively inflexible; a condition which worsens at cold temperature. Further, there is relatively little space for the harnessed cables.

SUMMARY OF THE INVENTION

In accordance with the invention, a system is provided including a slip ring plate and a brush assembly. The disk-shaped slip ring plate is mounted to a first gimbal member and has a plurality of concentric, truncated circular shaped electrical conductive segments disposed on one surface thereof, the electrical conductive segments being electrically insulated from each other. The brush assembly has a like plurality of brushes, each of the brushes being positioned in electrical contact with a corresponding one of the plurality of conductive segments while the brush assembly and disk-shaped ring platter rotate with respect to each other about an axis common to the concentric, truncated circular shaped conductive segments.

In accordance with another embodiment of the invention, a gimbal system is provided including a slip ring plate and a brush assembly. The disk-shaped slip ring plate is mounted to a first gimbal member and has a plurality of truncated circular shaped electrical conductive segments disposed on one surface of thereof, such circular shaped conductors having a common central axis, a plurality of the electrical conductive segments being disposed along a common radius from the central axis, the conductive segments being electrically insulated from each other. The brush assembly has a like plurality of brushes, each of the brushes being positioned in electrical contact with a corresponding one of the plurality of conductive segments while the brush assembly and disk-shaped ring platter rotate with respect to each other about an axis common to the concentric, truncated circular shaped conductive segments.

In accordance with another embodiment of the invention, a gimbal system is provided. A disk-shaped slip ring plate is mounted to a first gimbal member having a plurality of electrically isolated sectors, each one of the sectors having truncated circular shaped electrically insulated conductive segments disposed on the surface, the circular shaped conductors having a common central axis. The system also includes a like plurality of brush assemblies, each one of the assemblies being positioned to electrically contact the segments in a corresponding one of the sectors while the brush assembly and disk-shaped ring platter rotate with respect to each other about an axis common to the concentric, truncated circular shaped conductive segments. Each one of the assemblies includes a plurality of brushes, each of the brushes being positioned in electrical contact with a corresponding one of the conductive segments in the sector associated with such brush assembly.

In accordance with another embodiment of the invention, a system is provided including a housing, a motor, a bearing, a slip ring, a gimbal, an elongate member, a plurality of conductive wires, and a brush assembly. The motor is mounted to the housing, the motor for providing torque to a rotatable portion thereof that is rotatable relative to the housing along an axis. The bearing is mounted to the housing and includes a rotatable portion that is rotatable relative to the housing about the axis. The disk-shaped slip ring includes a surface on which a plurality of arcuate conductors are disposed, the plurality of arcuate conductors being concentric about the axis and separated by at least one electrically insulative discontinuity extending radially from the axis, the slip ring defining an arcuate opening that is concentric about the axis and that is partially defined by endwalls. The gimbal is nonrotatably coupled to the rotatable portion of the motor and to the rotatable portion of the bearing. The elongated member is attached to the gimbal and extends through the arcuate opening. The plurality of conductive wires are each electrically connected to one of the plurality of arcuate conductors. The brush assembly is fixedly attached to the housing and includes a plurality of conductive brushes each electrically contacting one of the plurality of arcuate conductors. When the motor rotates the gimbal, the slip ring is substantially stationary while the elongated member is displaced from the endwalls of the arcuate opening and is urged to rotate about the axis when the elongated member is forced against an endwall of the arcuate opening.

In accordance with another embodiment of the invention, an assembly is provided. The assembly includes a gimbal and a slip ring defining an axis and including a plurality of arcuate conductors that are concentric about the axis, the slip ring further defining an arcuate opening that is concentric about the axis and that is partially defined by endwalls. A elongated member extends from the gimbal through the arcuate opening, the elongated member being configured to move angularly within the arcuate opening when the gimbal and slip ring are rotated with respect to each other about the axis, and to engage the endwalls of the arcuate opening.

In accordance with another embodiment of the invention, an assembly is provided. A gimbal includes a first gimbal engaging surface and a second gimbal engaging surface. An electrically insulative disk is coupled to the gimbal and defines an axis, the disk being rotatable relative to the gimbal about the axis. The disk includes a plurality of arcuate conductors that are concentric about the axis and are disposed on a surface of the disk, a first disk engaging surface, and a second disk engaging surface angularly displaced about the axis from the first disk engaging surface. The first disk engaging surface is disposed to interfere with the first gimbal engaging surface to induce rotation of the gimbal relative to the disk in a first angular direction, and the second disk engaging surface is disposed to interfere with the second gimbal engaging surface to induce rotation of the gimbal relative to the disk in a second angular direction.

Various aspects of the invention may include one or more of the following advantages. Large amounts of conductor runs can pass from one axis to another without typical wire bundling, service loop coiling, or along-axis feed through. Wide angle field of view (FOV) capabilities are provided while also providing low friction to inertia, and accommodating for environmental requirements such as acceleration and vibration, and accommodating look angle and packaging constraints. Large wire counts are provided in highly flexible, non-binding flex prints that can accommodate large rotation angles without requiring a large volume. Conductor runs can be shielded to reduce electromagnetic interference in easily-producible flex print cabling that provides reliable, high-quality performance. Small angle (e.g., 5–10°) rotation is provided for without significant, if any, slip ring rotation. Slip ring wear is reduced and lifetime lengthened compared to traditional slip rings. Noise between brush contacts and slip ring conductors is reduced, if not eliminated, compared to traditional slip rings. Larger arcuate slip ring travel is provided than the arcuate length of a sector of conductors on a slip ring. Brush contacts slide very little, if at all, on corresponding slip ring conductors during small-angle rotation stabilization of a gimbal. Freely flexible, shielded wiring for a yaw axis is provided. Mechanical flexibility and rotation of the yaw axis of approximately ±25° using a freely flexing, shield cable are provided. Freely flexing, shielded cabling is provided for the pitch axis. Gimbal system cabling is electromagnetically shielded. A slip ring arrangement can be used with less than a four-inch circumferential conductor length of unshielded conductor. A slip ring is provided that has a more modular, conformed packaging with improved ease of installation and repair, producibility and reliability than traditional slip ring gimbal systems. Electrical contact with conductors of the slip ring can be maintained even if a contact to a conductor breaks or otherwise fails. Wide angle FOV is attainable for the pitch axis with little, if any, wiring restriction or induced cabling torque. An increased number of connector runs can be provided compared to traditional slip ring designs. Yaw cables provide a more flexible, less motion restricted, lower torque, and improved ease of assembly, compared to traditional slip ring gimbal systems. Friction to inertia of the slip ring and brush contacts is reduced compared to traditional slip ring designs, improving performance.

BRIEF DESCRIPTION OF THE DRAWINGS

Other features and advantages of the invention, as well as the invention itself, will become more readily apparent when taken together with the following detailed description and the accompanying drawings, in which.

DESCRIPTION OF PREFERRED EMBODIMENTS

Figure 1:
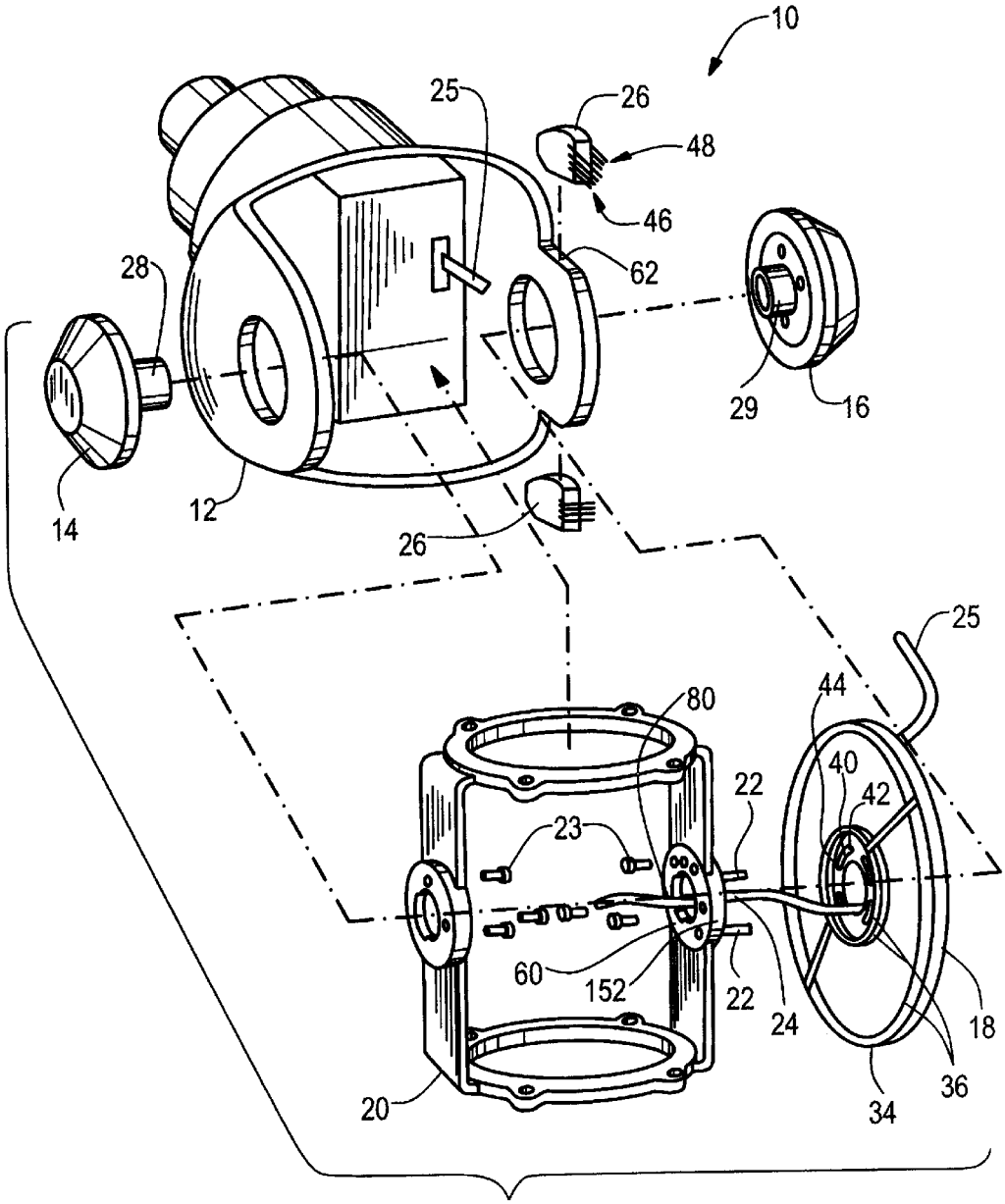
FIG. 1 is an exploded isometric view of a gimbal assembly.
Figure 2:
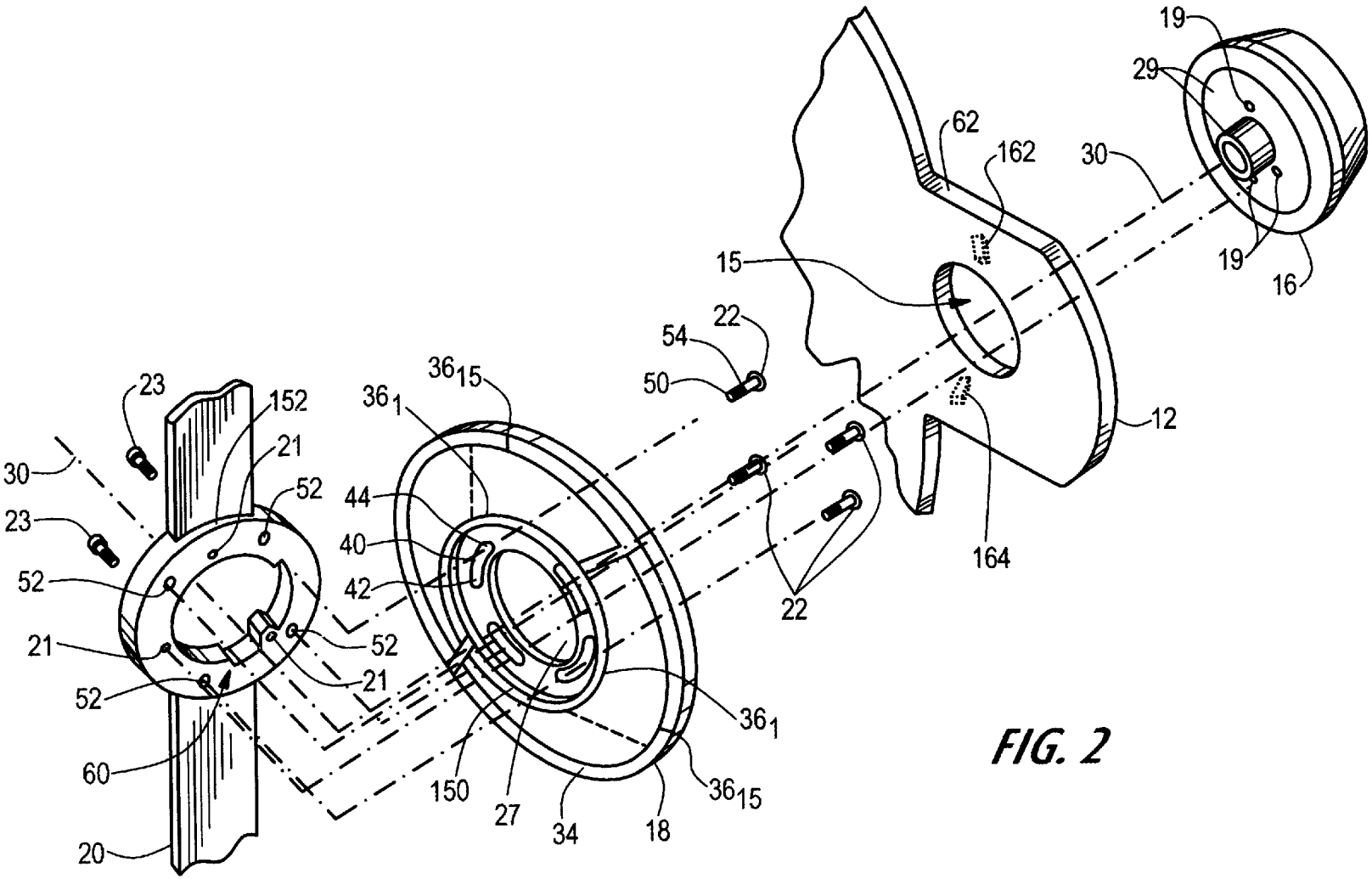
FIG. 2 is an exploded view of a portion of a gimbal, a slip ring, a portion of a housing, two motors, and several elongated fastening members all shown in FIG. 1.
Figure 3:
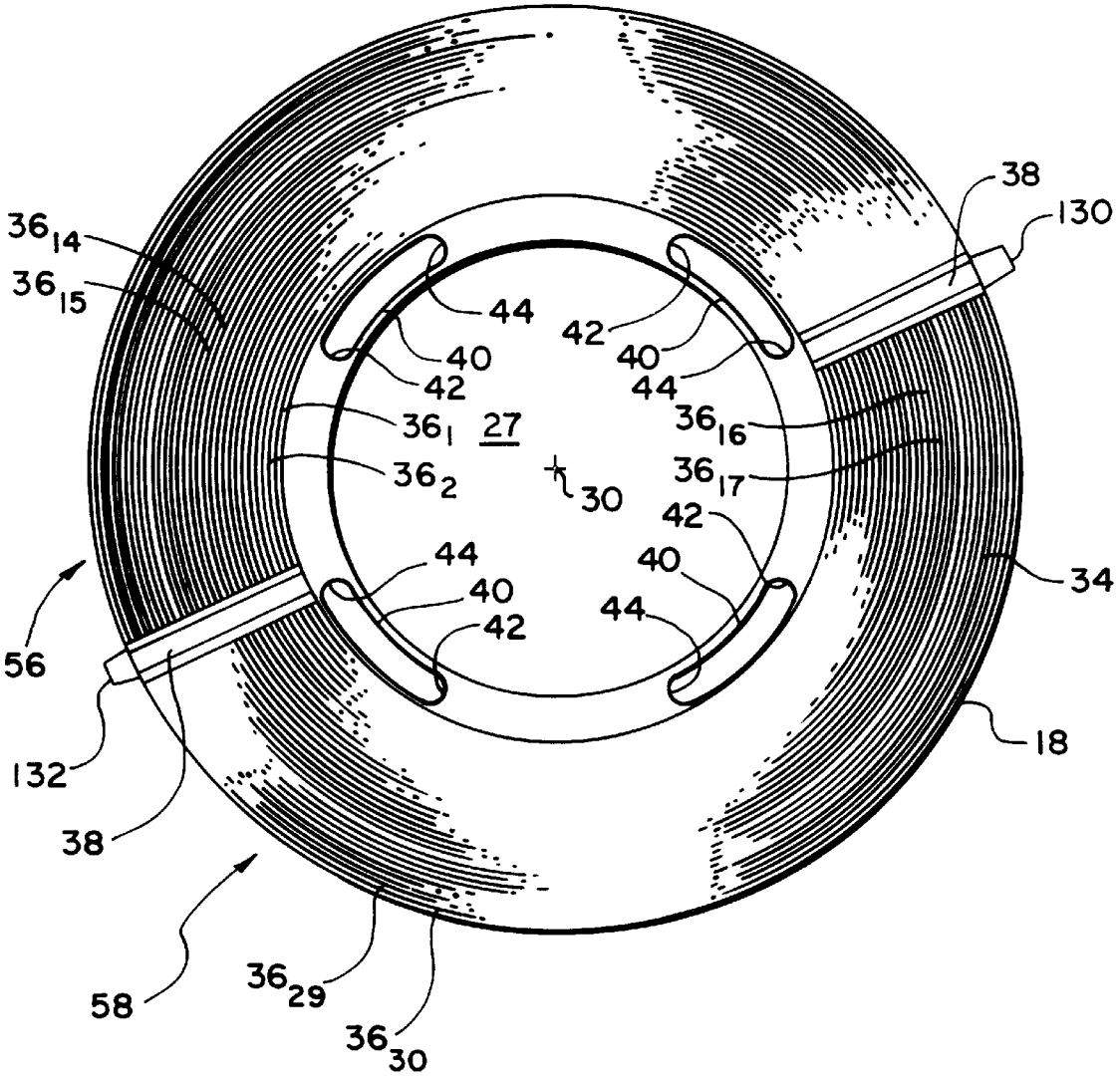
FIG. 3 is a top view of the slip ring shown in FIG. 2.

FIGS. 1–2 show a gimbal system 10 comprising a housing 12, two motors 14 and 16, a disc-shaped slip ring 18, a gimbal ring 20, four elongated members 22, a yaw axis flex cabling 24, a pitch axis flex cabling 25 and two brush assemblies 26. As shown, the motors 14 and 16 can be mounted to the housing 12 and can provide torque to portions 28 and 29 of the motors 14 and 16, respectively, that are rotatable relative to the housing 12 along an elevational, or pitch, axis 30. The rotatable portions 28 and 29 are fixed to the gimbal 20. The slip ring 18 includes a surface 34 on which a plurality, e.g., thirty, arcuate conductors 36 25 are disposed. The conductors 36 are concentric about the axis 30 in two sets of fifteen conductors 36 with pairs of conductors being disposed equidistant from the axis 30 and electrically insulated from each other by two electrically insulating discontinuities 38. The slip ring 18 provides 30 four arcuate openings or slots 40 centered about the axis 30 and disposed equidistant therefrom, and partially defined by end walls 42 and 44 respectively (FIGS. 2–3). The gimbal 20 is nonrotatably coupled to the rotatable portions 28 and 29 of the motors 14 and 16 by screws 23. The elongated members 22 have arcuate widths that are less than the arcuate widths of the corresponding arcuate openings 40 in the slip ring 18. The elongated members 22 are attached to the gimbal 20 through the arcuate slots 40 in the slip ring 18. The yaw axis cabling 24 includes a plurality of conductive wires each electrically connected to one of the arcuate conductors 36. The brush assemblies 26 are fixedly attached to the housing 12 and each includes a plurality of conductor brushes 46 and 48 that, when the system 10 is assembled, each contact one of the arcuate conductors 36 (or 37, FIG. 4), respectively. With this arrangement, when the motors 14 and 16 rotate the gimbal 20, the slip ring 18 is substantially stationary while the elongated members 22 are displaced from the end walls 42 and 44 of the arcuate openings 40 and is urged to rotate about the axis 30 when the elongated members 22 are forced against the end walls 42 or 44 of the arcuate openings 40.

Referring to FIG. 2, the motor 16 is mounted to the housing 12 and fixedly attached to the gimbal 20. The motor 16 is fixedly mounted to the housing 12, e.g., with screws (not shown). The rotatable portion 29 of the motor 16 is fixedly attached to the gimbal 20 with screws 23. The screws 23 extend through holes 21 in the gimbal 20, an opening 27 in the slip ring 18, and an opening 15 in the housing 12 and are received by mating threaded holes 19 in the portion 29. The motor 14 is similarly attached to the housing 12 and to the gimbal 20.

As shown, the slip ring 18 is disposed between the housing 12 and the gimbal 20, and mates with the gimbal 20. A circular recess 150 in the slip ring 18 is centered along the pitch axis 30. The recess 150 is sized and shaped to receive a cylinder 152 extending from the gimbal 20 along the pitch axis 30. The cylinder 152 and the recess 150 help to align the slip ring 18 while permitting the slip ring 18 to rotate relative to the gimbal 20 about the pitch axis 30.

The elongated members 22 help retain the relationship of the gimbal 20 relative to the slip ring 18, with the cylinder 152 received by the recess 150. The elongated members 22 are screws with threaded ends 50 for threadedly engaging threaded holes 52 in the gimbal 20. The elongated members 22 have smooth cylindrical portions 54 that can be made, or coated, with, e.g., teflon. The cylindrical portions 54 extend through the arcuate openings 40 in the slip ring 18. The cylindrical portions 54 are sized such that they have a width, or subtend and arc measured from the axis 30, that is less than the arcuate length (i.e., the arc subtended as measured from the axis 30), of the arcuate openings 40. The cylindrical portions 54 are also sized such that the elongated members 22 can slide within the arcuate openings 40 in the slip ring 18. The elongated members 22 have a length such that when they are tightened into the holes 52 in the gimbal 20, the recess 150 of the slip ring 18 receives the cylinder 152 of the gimbal 20 while allowing relative rotational motion between the gimbal 20 and the slip ring 18.

As shown in FIG. 3, the surface 34 of slip ring 18 has a number, here fifteen, concentric truncated circular, or arcuate, electrical conductors 36 centered about the axis 30. The electrical conductors are circular about the axis 30 and are truncated and arranged in two sectors 56 and 58. Each of the sectors 56 and 58 contains fifteen electrical conductors 36 that are each about 0.0003 inch gold deposited in an approximately 0.025 inches wide, 0.009 inches deep, "V" groove in the slip ring 18. Sector 56 contains electrical conductors $\mathbf{36}_1$, $\mathbf{36}_2$, . . . $\mathbf{36}_{15}$ while sector 58 contains conductors $\mathbf{36}_{16}$ $\mathbf{36}_{17}$, . . . $\mathbf{36}_{30}$. Pairs of the conductors 36, one from each of the two sectors 56 and 58, are equidistant from the axis 30. In other words, conductors $\mathbf{36}_1$ and $\mathbf{36}_{16}$ are equidistant from the axis as are conductors $\mathbf{36}_2$ and $\mathbf{36}_{17}$ . . . , and conductors $\mathbf{36}_{15}$ and $\mathbf{36}_{30}$. More or fewer conductors 36 can be provided on the slip ring 18 depending on the application. The slip ring 18 is made of an electrically insulating material such as glass epoxy and has a circumference of about four inches.

The surface 34 of slip ring 18 also includes the two electrically insulating discontinuities 38. The discontinuities 38 are equispaced about the axis 30 and electrically isolate the sectors 56 and 58 by providing an arcuate expanse of the insulating material separating the conductors 36 along a radial strip on the surface 34 of the slip ring 18. More sectors can be provided by forming more discontinuities 38 on the slip ring 18. Although the sectors 56 and 58 are shown of equal angular extent, the discontinuities 38 can be unevenly spaced to provide sectors of unequal angular extent. This directly impacts available gimbal travel and field of view.

Figure 4:
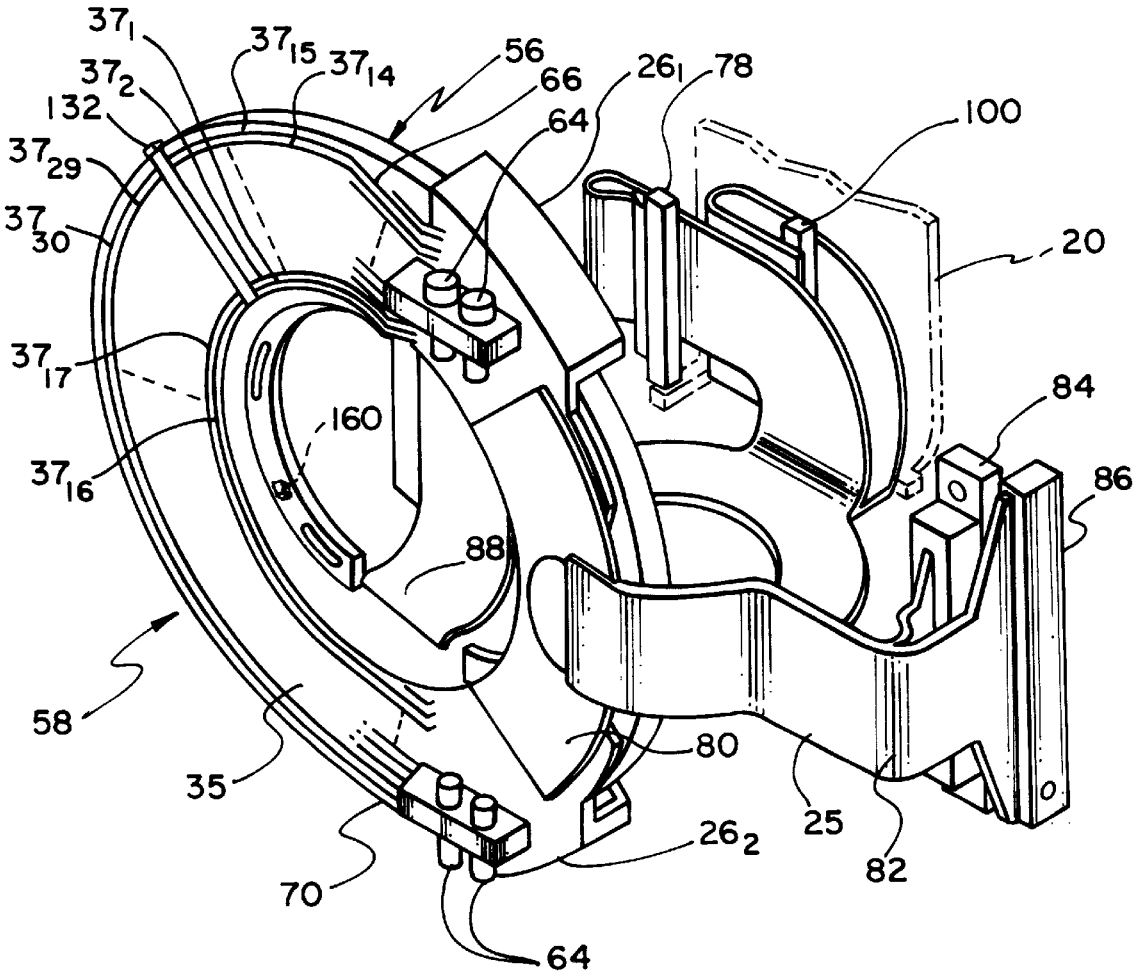
FIGS. 4–5 are isometric views with portions of the housing and the gimbal shown in dashed lines.

A similar arrangement is provided on the opposite side 35 of the slip ring 18, with conductors $\mathbf{37}_1$–$\mathbf{37}_{30}$ separated by discontinuities 39 (FIG. 4).

The slip ring 18 also includes the four arcuate slots 40 centered about the axis 30. The arcuate slots 40 each subtend an arc of about 5–10° plus the arcuate width of the elongated members 22.

Other features are included in the slip ring 18. A rectangular cutout 60 (FIGS. 1 and 2) is provided in the slip ring 18 to accommodate the yaw axis cabling 24 (FIG. 1). Internal groundplanes (not shown) are provided inside the slip ring 18 between surfaces 34 and 35.

Figure 5:
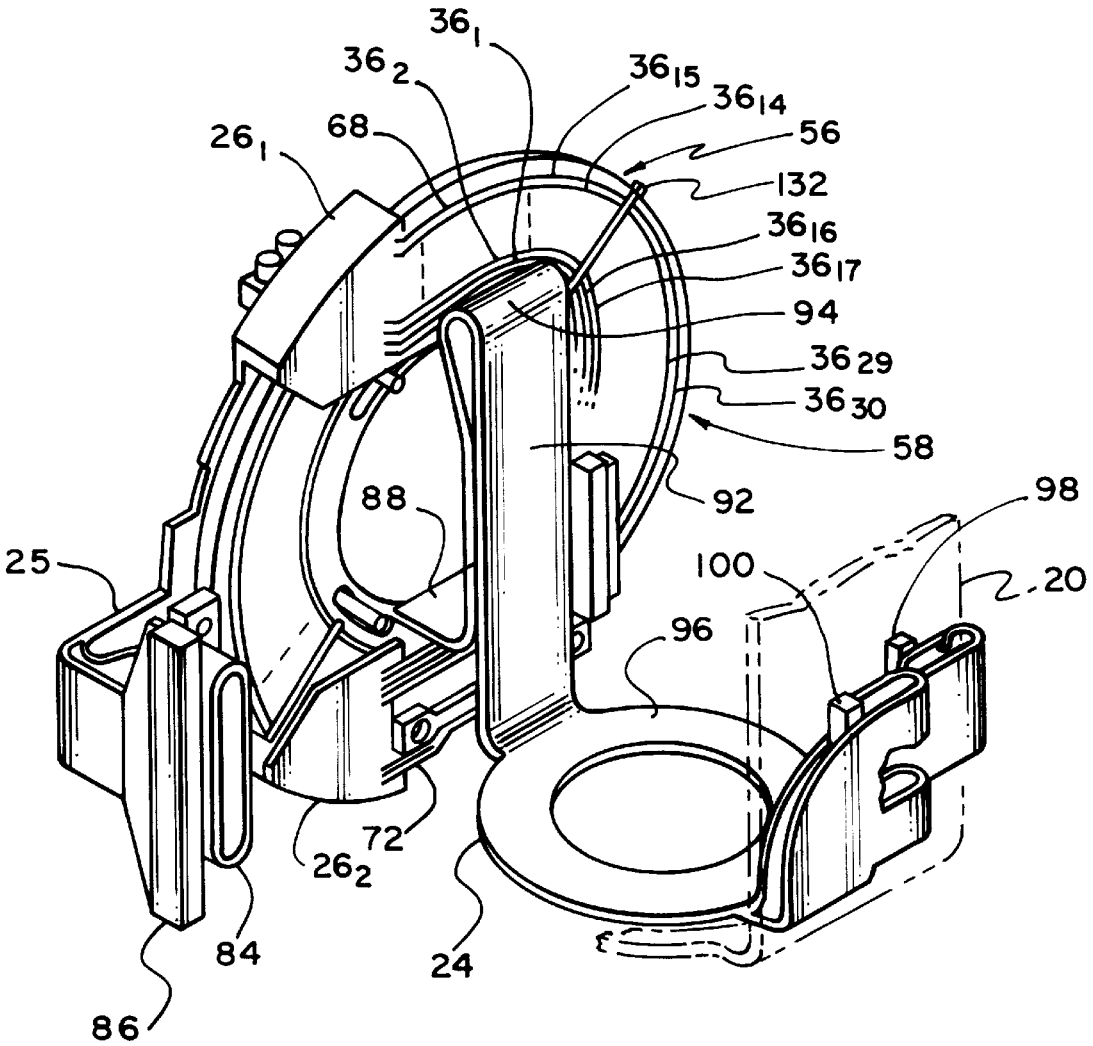

FIGS. 4–5 show the slip ring 18, the brush assemblies 26, the yaw axis cabling 24 and the pitch axis cabling 25 as assembled with the gimbal 20 and the housing 12, although the housing 12 is not shown for clarity and the gimbal 20 is only partially shown in dash lines for clarity. The gimbal 20 is mounted as described above through the slip ring 18 with the elongated members 22 (FIGS. 1–2). The brush assemblies 26 are mounted to the housing 12 along ledges 62 using screws 64.

Each of the brush assemblies $\mathbf{26}_1$ and $\mathbf{26}_2$ have twice as many brush contacts 66 and 68, and 70 and 72, respectively, per sector 56 and 58 as there are electrical conductors 36 per sector 56 and 58. The brush contacts 66, 68, 70, and 72 are arranged redundantly such that two brush contacts 66, 68, 70, or 72 touch or contact each one of the electrical arcuate conductors 36 and 37. The brush contacts 66, 68, 70 and 72 extend from the respective brush assemblies 26 and are angled toward the respective electrical conductors 36 and 37 such that the brush contacts 66, 68, 70, and 72 are spring biased into electrical contact with the respective electrical arcuate conductors 36 and 37. The redundant brush contacts 66, 68, 70, and 72 have different lengths and different natural frequencies. This helps to maintain contact between the brush contacts 66, 68, 70, and 72 with the conductors 36 and 37 in vibrational environments. The brush contacts 66, 68, 70 and 72 are made of a gold alloy, e.g., gold, silver, and nickel, to provide good electrical contact, good wear resistance and low Coulombic friction. Total friction between the brush contacts 66, 68, 70 and 72 and the electrical conductors 36 is approximately 5 inches-ounce. This friction inhibits rotation of the slip ring 18 when the elongated members 22 are not in contact with at least one end wall 42 or 44 of the arcuate slots 40, thus allowing the gimbal 20 to rotate relative to the slip ring 18. The brush contacts 66, 68, 70 and 72 are electrically coupled to the yaw axis cabling 24 through the arcuate electrical conductors 36 and 37 and the slip ring 18. The brush contacts 66, 68, 70 and 72 are electrically coupled to the brush assemblies 26 and to one end of the pitch axis cabling 25.

The pitch axis cabling 25 includes a brush block assembly connecting portion 80 and a regulator board connecting portion 82. The portion 80 electrically couples to the outputs from the brush contacts 66, 68, 70 and 72 and to the portion 82. The portions 80 and 82 contain one electrical conductor for each of the arcuate conductors 36 within a flexible layer of kapton that insulates the conductors and provides electromagnetic interference (EMI) shielding. The portions 80 and 82 can contain the conductors therein between two 0.001 inch thick kapton layers bonded with an acrylic adhesive. The conductors in the portions 80 and 82 are 0.5 or 1.0 ounce copper traces (0.0007 or 0.0014 inches thick) with 15 conductors spaced within a 0.025 inch pitch. The conductors associated with each sector of the slip ring 18 can be contained in its own kapton-enclosed flexible cabling. Thus, there are four kapton-enclosed flexible cablings in each of the portions 80 and 82. Thus, the portions 80 and 82 are layered with conductors in conductive layers enclosed therein with shielding layers disposed between the conductive layers. The end of the portion 82 displaced from the portion 80 splits and is connected to two connectors 84 and 86. The conductors in the portion 82 are electrically coupled to connector pins (not shown), e.g., by soldering, and encapsulated. The connectors 84 and 86 are adapted to be coupled through mating connectors (not shown) to circuitry, such as a regulator board (FIG. 7), for electrical processing.

The yaw axis cabling 24 is electrically coupled to, and extends from, the slip ring 18. The yaw axis cabling 24 is made of a flexible cabling of kapton shielding surrounding layers of electrical conductors similar to the portion 82 of the pitch axis cabling 25. Four sets of conductors (not shown) are electrically coupled through the slip ring 18 to the four sets of arcuate electrical conductors 36 and 37 of the slip ring 18. A portion 88 of the cabling 24 extends through an opening 90 (FIG. 1) in the gimbal 20. A portion 92 of the cabling 24 disposed within the gimbal 20 extends upwardly to a bend 94 and then downwardly to a circular portion 96 that transverses the interior of the gimbal 20. The bend 94 provides a service bend area for mechanical flexibility and rotation of the gimbal in the yaw axis (FIG. 8) of approximately ±25°. The flex cabling 24 splits and is connected to two connectors 98 and 100, with the conductors in the cabling 24 being soldered to connector pins (not shown) of the connectors 98 and 100. The connectors 98 and 100 are adapted to be coupled through mating connectors (not shown) to circuitry, such as a sensor assembly, for electrical processing.

The slip ring 18, brush assemblies 26, and cablings 24 and 25 are adapted to conduct approximately two amps continuously or up to three amps for up to approximately 400 milliseconds.

The kapton shieldings are terminated to ground planes within the slip ring 18, to shield pins within the connectors 98, 100, 84, and 86, and to external connector shells of these connectors to help adhere to the Electromagnetic Environmental Effects (E3) design guidelines.

The system 10 can be assembled as shown in FIGS. 1–2. The motor 14 is fixedly attached, e.g., with screws, to the housing 12 and the rotatable portion 28 is screwed to the gimbal 20 with screws 23. The elongated members 22 are inserted through the arcuate slots 40 in the slip ring 18, and tightened into the threaded openings 52 in the gimbal 20. The motor 16 is fixedly attached, e.g., with screws, to the housing 12, and the gimbal 20 is fixedly attached to the portion 29 with screws 23. The brush assemblies 26 are screwed into the housing 12 and arranged such that the brush contacts 66, 68, 70 and 72 are in electrical contact with the electrical conductors 36 and 37 of the slip ring 18. The yaw axis cabling 24 is threaded through the opening 90 in the gimbal 20 and the connectors 98 and 100 are connected to appropriate mating connectors (not shown). Similarly, connectors 84 and 86 of the pitch axis cabling 25 are connected to appropriate mating connectors (not shown).

Figure 6:
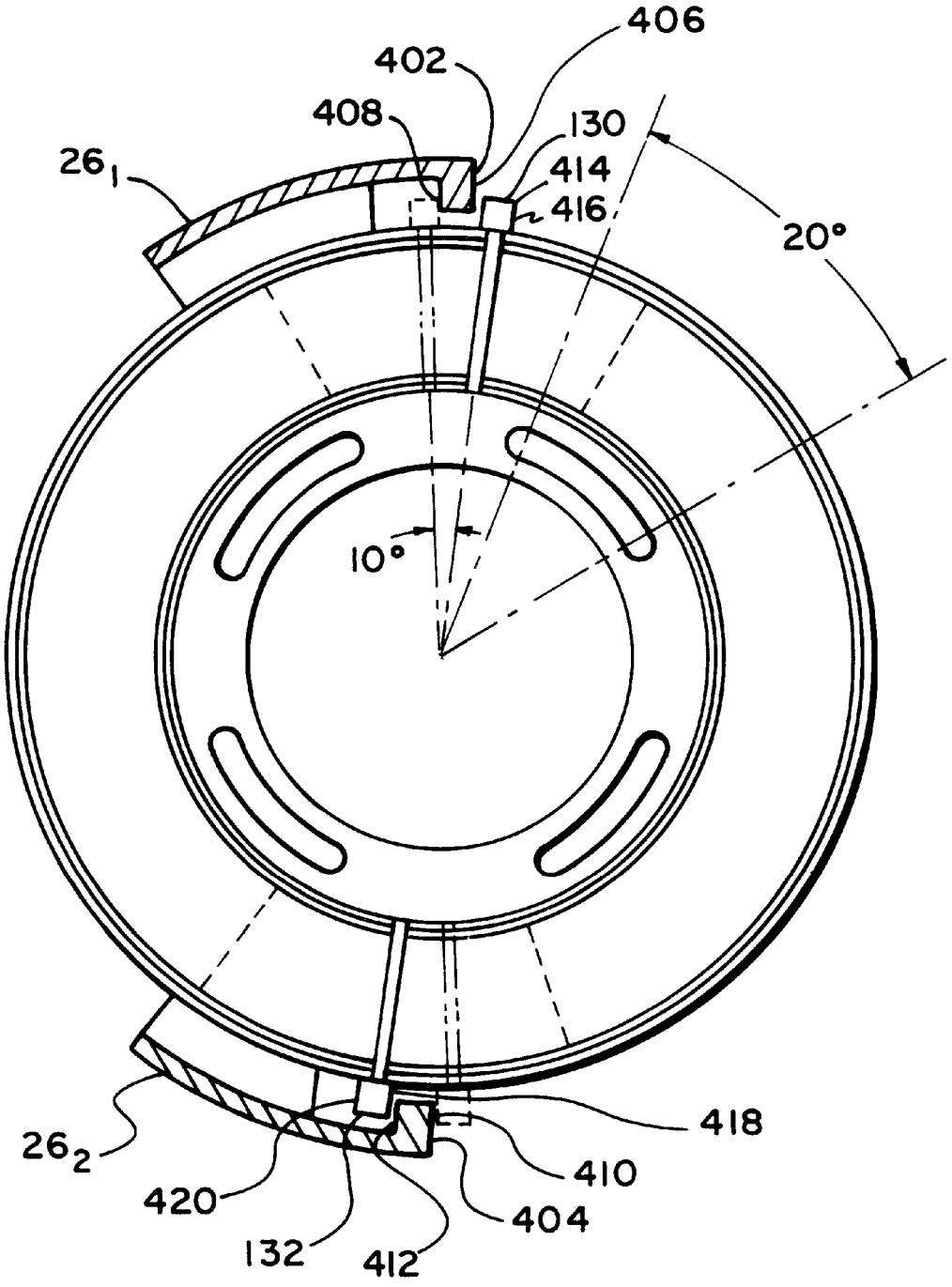
FIG. 6 is a top view of the slip ring shown in FIG. 2 with brush assemblies, shown in cross section, disposed adjacent the slip ring similar to the configuration shown in FIGS. 4–5.

As shown in FIG. 6, the slip ring 18 includes two slip ring stops 132, 134 (FIG. 4) and the brush assemblies 26 and 262 include brush assembly stops 402, 404 with corresponding engaging surfaces 406, 408 and 410, 412, respectively. The slip ring 18 includes engaging surfaces 414, 416, 418, and 420 arranged so that when the slip ring 18 rotates with respect to the brush assemblies 26 about the pitch axis 30, the surfaces 414, 416, 418, and 420 will contact the corresponding engaging surfaces 406, 410, 412, and 408 of the brush assemblies 26 to inhibit further rotation of the slip ring 18. The stops 130, 132 are shown in phantom in position for contacting the surfaces 408 and 420.

The limits on the rotation of the slip ring 18 about the pitch axis 30 are determined by the locations of the stops 132, 134 and 402, 404. These stops 132, 134, 402, 404 are preferably arranged in accordance with the slip ring sectors 56 and 58 so that the brush contacts 66, 68, 70 and 72 do not extend into the discontinuities 38 and 39 when the gimbal 20 is rotated about the pitch axis 30 relative to the housing 12. This inhibits loss of electrical contact with the arcuate electrical conductors 36 and 37.

The gimbal 20 can rotate about the pitch axis 30 further than the slip ring 18. The slip ring 18 cannot exceed 180° of travel (in this embodiment) in order to maintain continuity and stay within the subtended angles of the sectors 56 and 58, assuming that the discontinuities 38 and 39 are of minimal width. The gimbal 20 is permitted to rotate further than the slip ring 18 approximately the arcuate length of the arcuate slots 40.

The permissible angle of rotation of the gimbal 20 relative to the housing 12 is reduced by the width of the discontinuities 38, 39, and the separation of the redundant brush contacts 66, 68, 70 and 72, assuming that none of the brush contacts 66, 68, 70 or 72 are allowed to lose electrical contact with the conductors 36 or 37, respectively. Thus, the arcs subtended by the arcuate slots 40, the width of the discontinuities 38, 39, and the angular separation of the brush contacts 66, 68, 70 and 72 will limit the amount of effective rotation about the pitch axis 30 that the gimbal 20 will preferably have. The amount of allowable rotation by the gimbal 20 is approximately equal to the angle subtended by the sectors 56, 58 (which inherently includes the width of the discontinuities 38, 39), plus the angle subtended by the arcuate slots 40, minus the angle subtended by the elongated members 22, minus the separation of redundant pairs of the brush contacts 66, 68, 70, 72.

Thus, if the sectors 56, 58 subtend angles of approximately 180° (assuming that the discontinuities 38 and 39 are of minimal width) and the arcuate slots subtend arcs of approximately 20°, plus a semicircular portion to accommodate the elongated members 22, and the separation of redundant pairs of brush contacts 66, 68, 70, 72 is 10°, then the gimbal 20 can rotate approximately 190° in each direction. Effectively there is 380° of travel from a disk of 360°.

Figure 7:
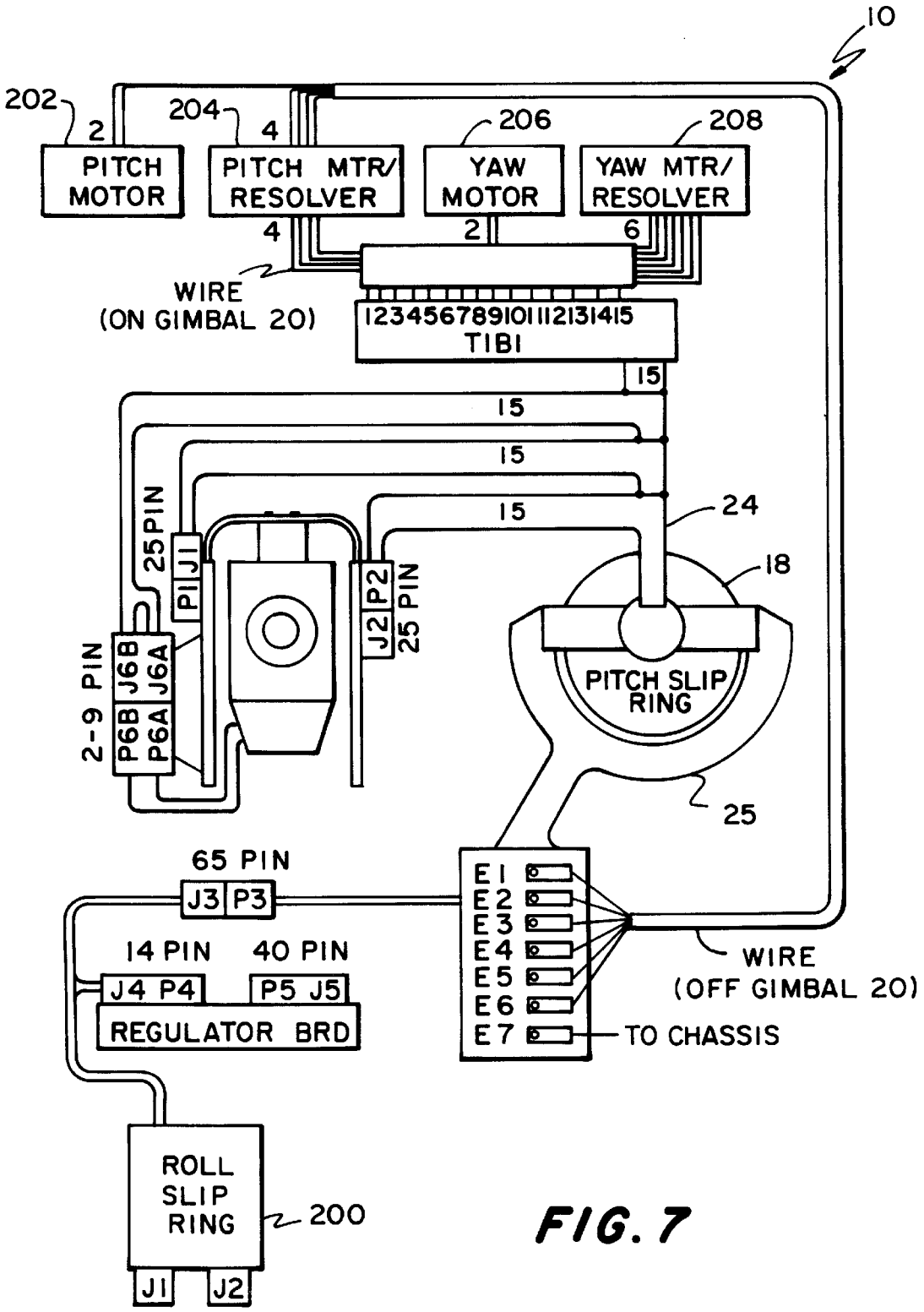
FIG. 7 is a schematic diagram of electrical connections for the assembly shown in FIG. 1.

As shown in FIG. 7, the slip ring 18 provides electrical connections between components for the system 10. The pitch axis cabling 25 and yaw axis cabling 24 are connected to the slip ring 18, with the yaw axis cabling 24 splitting into four cables with 15 electrical lines each. The connections provide communication for a roll slip ring 200, a pitch motor 202, a pitch motor/resolver 204, a yaw motor 206, and a yaw motor/resolver 208. As shown, some wires connected to the motors and resolvers 202, 204, 206, 208 are off of the gimbal 20 and some are on the gimbal 20. This helps facilitate installation/removing motors, resolvers, etc.

Figure 8:
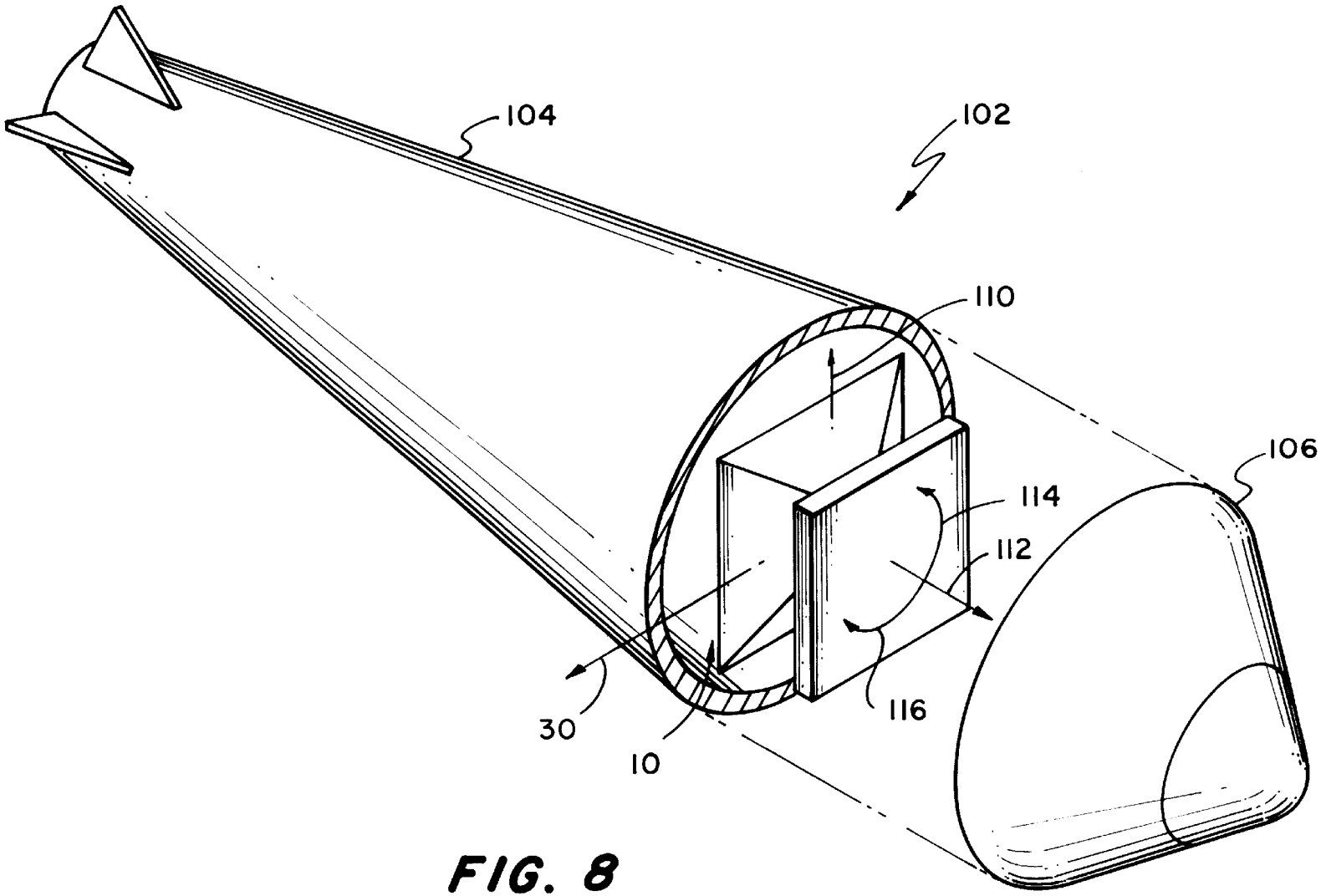
FIG. 8 is a partially-exploded perspective view of a missile employing the gimbal system shown in FIG. 1.

As shown in FIG. 8, the gimbal system 10 can be mounted, e.g., in a missile 102. As shown, the gimbal system 10 is mounted at the front of a body 104, and inside a infrared dome 106, of the missile 102. A seeker is pivotable and/or rotatable about a yaw axis 110, a roll axis 112, and the pitch axis 30. About pitch axis 30, the gimbal 20, and therefore the seeker, is rotatable in directions 114 and 116.

In operation, the motors 14 and 16 can rotate the gimbal 20 about the pitch axis 30 in directions 114 and 116. As the gimbal 20 rotates; the elongated members 22 will move within the arcuate slots 40. The elongate members 22 can move within the slots 40 through the entire arcuate lengths subtended by the slots 40 without causing the slip ring 18 to rotate about the pitch axis 30. Thus, the gimbal 20 can rotate (i.e., dither) back and forth approximately ±10° without causing rotation of the slip ring 18. Slight adjustments in the pitch angle of the gimbal 20 therefore do not cause rotation of the slip ring 18.

Significant rotation, e.g., in direction 114, of the gimbal 20 about the pitch axis 30 will cause the slip ring 18 to rotate. Once the motor 14 has rotated the gimbal 20 far enough that one or more of the elongated members 22, and in particular the smooth cylindrical portions 54, engages and is forced against an end wall 42 or 44 of the arcuate slots 40, the slip ring 18 will rotate. Thus, the outer surfaces of the smooth cylindrical portions 54 of the elongated members 22 act as engaging surfaces to engage and press against complimentary engaging surfaces 42 or 44 of the slip ring 18, to induce rotation of the slip ring 18 about the pitch axis 30.

As the slip ring 18 rotates, the redundant brush contacts 66, 68, 70 and 72 remain in electrical contact with corresponding ones of the arcuate electrical conductors 36 and 37 of the slip ring 18. This helps maintain electrical continuity in the gimbal system 10.

The slip ring 18 can rotate about the pitch axis 30 in direction 114 until surfaces 414, 418 of the slip ring stops 132, 134 contact the surfaces 406, 412 of the brush assembly stops 402, 404. This defines the limit of rotation of the slip ring about the pitch axis 30 in direction 114.

The motors 14 and 16 can also rotate the gimbal 20 about the pitch axis in the opposite direction 116. The slip ring 18 will not be rotated until one or more of the elongated members 22 contacts the other one of the end walls 42 or 44 of the arcuate slots 40. The motors 14 and 16 can rotate the gimbal 20 in the opposite direction 116 until the slip ring 18, as forced by the elongated members 22, reaches its other maximum rotated position when the surfaces 416, 420 of the slip ring stops 132, 134 contact the surfaces 410, 408 of the brush assembly stops 402, 404.

Other embodiments are within the scope of the appended claims. For example, instead of mechanical stops provided on the slip ring 18 and the brush assemblies 26 to inhibit rotation of the slip ring 18 about the pitch axis 30, mechanical or electrical stops may be implemented in the motor area. The stops 132, 134, 402, and 404 provide safeguards in case of failures. If stopping commands are programmed into software control of the motor 14, and if this software fails, or if motor circuitry fails, then the mechanical and electrical hardware of the system 10 is protected by the stops 132, 134, 402, and 404 inhibiting rotation of the slip ring 18 as described. A slip ring stop 160 (shown in dashed lines in FIG. 4) and two housing stops 162, 164 (shown in dashed lines in FIG. 2) can be used to limit or inhibit rotation of the gimbal 20 relative to the housing 12.

What is claimed is:

1. A system having a pair of members, a first one of such members being rotatably mounted to a second one of the members about an axis, such system, comprising:

a first plurality of electrical cables, each one of such cables having a first plurality of electrical conductors;

a second plurality of electrical cables, each one of such cables having a second plurality of electrical conductors;

an electrical interconnecting structure for electrically interconnecting each one of the first plurality of electrical conductors to a corresponding one of the second plurality of electrical conductors, such electrical interconnecting structure comprising:

a disk-shaped slip ring plate having a plurality of electrically isolated arcuate sectors, each one of the sectors having a plurality of concentric, truncated circular shaped electrical conductive segments disposed on one surface of the plate, each one of the plurality of segments in each one of the sectors being electrically connected to a corresponding one of the first plurality of electrical cables, the electrical conductive segments being electrically insulated from each other; and a plurality of brush assemblies fixedly mounted to the second one of the members, each one of the brush assemblies being electrically connected to the plurality of segments in a corresponding one of the sectors while the brush assembly and disk-shaped slip ring plate rotate with respect to each other about the axis, such axis being common with the center of the concentric circular shaped conductive segments.

2. The system recited in claim 1 wherein the slip ring has an arcuate opening therein concentric about the axis, such opening being partially defined by endwalls; and wherein the first one of the members has an elongated member extending from the first one of the member through the arcuate opening, the elongated member being configured to move angularly within the arcuate opening when the first one of the members and slip ring are rotated with respect to each other about the axis, and to engage the endwalls of the arcuate opening.

3. The system recited in claim 2 wherein the arcuate opening subtends an angle, having a vertex at the axis, of less than about 10 degrees.

* * * * *

UNITED STATES PATENT AND TRADEMARK OFFICE

CERTIFICATE OF CORRECTION

PATENT NO. : 6,386,886 B1
DATED : May 14, 2002
INVENTOR(S) : Filaretos

It is certified that error appears in the above-identified patent and that said Letters Patent is hereby corrected as shown below:

Column 7,
Line 36, delete "26 and 262" and replace with -- $26_1$ and $26_2$ --

Signed and Sealed this

Fifth Day of November, 2002

*Attest:*

*Attesting Officer*

JAMES E. ROGAN
*Director of the United States Patent and Trademark Office*